US010662940B2

(12) United States Patent
Lehmeier et al.

(10) Patent No.: US 10,662,940 B2
(45) Date of Patent: May 26, 2020

(54) HIGH-PRESSURE FUEL PUMP

(71) Applicant: Robert Bosch GmbH, Stuttgart (DE)

(72) Inventors: Christoph Lehmeier, Pilsach (DE); Torsten Schoene, Schwabach (DE); Stefan Brueckl, Fuerth (DE); Soeren Stritzel, Rayong (TH); Heiko Jahn, Tamm (DE); Stefan Kaufmann, Schwabach (DE); Achim Laub, Waiblingen (DE); Manuel Wacker, Fuerth (DE)

(73) Assignee: Robert Bosch GmbH, Stuttgart (DE)

( * ) Notice: Subject to any disclaimer, the term of this patent is extended or adjusted under 35 U.S.C. 154(b) by 234 days.

(21) Appl. No.: 15/576,160

(22) PCT Filed: Apr. 7, 2016

(86) PCT No.: PCT/EP2016/057572
§ 371 (c)(1),
(2) Date: Nov. 21, 2017

(87) PCT Pub. No.: WO2016/188661
PCT Pub. Date: Dec. 1, 2016

(65) Prior Publication Data

US 2018/0135619 A1 May 17, 2018

(30) Foreign Application Priority Data

May 22, 2015 (DE) ..... 10 2015 209 539

(51) Int. Cl.
*F04B 53/14* (2006.01)
*F02M 59/44* (2006.01)
(Continued)

(52) U.S. Cl.
CPC ..... *F04B 53/143* (2013.01); *F02M 59/02* (2013.01); *F02M 59/025* (2013.01);
(Continued)

(58) Field of Classification Search
CPC ..... F04B 1/0448; F04B 19/22; F04B 53/143; F02M 2200/80; F02M 2200/8061;
(Continued)

(56) References Cited

U.S. PATENT DOCUMENTS 8,556,602 B2 * 10/2013 Mancini ..... F04B 53/143 277/566

FOREIGN PATENT DOCUMENTS

CN 101094988 A 12/2007
CN 101646860 A 2/2010
(Continued)

OTHER PUBLICATIONS

International Search Report corresponding to PCT Application No. PCT/EP2016/057572, dated Jun. 13, 2016 (German and English language document) (7 pages).

*Primary Examiner* — Peter J Bertheaud
(74) *Attorney, Agent, or Firm* — Maginot, Moore & Beck LLP

(57) ABSTRACT

A high-pressure fuel pump includes a housing, at least one piston, and a sealing device. The device is positioned on the piston so as to surround the piston, and includes a seal carrier. The carrier is connected, at least in sections, to the housing, and includes at least one radially peripheral portion that is materially bonded to the housing via a capacitor discharge weld connection. Such a pump enables improved cycle times and reduced error rates during production.

9 Claims, 6 Drawing Sheets

(51) Int. Cl.

| | |
|---|---|
| ***F04B 1/0408*** | (2020.01) |
| ***F02M 59/02*** | (2006.01) |
| ***F04B 19/22*** | (2006.01) |
| ***F02M 59/10*** | (2006.01) |
| ***F04B 1/0426*** | (2020.01) |
| ***F04B 1/0448*** | (2020.01) |
| *F02M 59/06* | (2006.01) |

(52) U.S. Cl.
CPC ..... *F02M 59/102* (2013.01); *F02M 59/442* (2013.01); *F04B 1/0408* (2013.01); *F04B 1/0426* (2013.01); *F04B 1/0448* (2013.01); *F04B 19/22* (2013.01); *F02M 59/06* (2013.01); *F02M 2200/8084* (2013.01)

(58) Field of Classification Search
CPC ..... F02M 2200/8084; F02M 59/02; F02M 59/025; F02M 59/442; F02M 59/48; F16J 15/56
See application file for complete search history.

(56) References Cited

FOREIGN PATENT DOCUMENTS

| | | | |
|---|---|---|---|
| CN | 102052220 | A | 5/2011 |
| DE | 103 22 598 | A1 | 12/2004 |
| DE | 10 2013 205 909 | A1 | 10/2014 |
| DE | 10 2013 206 930 | A1 | 10/2014 |
| EP | 2 317 119 | A1 | 5/2011 |
| JP | 2009-108784 | A | 5/2009 |
| WO | 2014/170105 | A1 | 10/2014 |

* cited by examiner

HIGH-PRESSURE FUEL PUMP

This application is a 35 U.S.C. § 371 National Stage Application of PCT/EP2016/057572, filed on Apr. 7, 2016, which claims the benefit of priority to Serial No. DE 10 2015 209 539.8, filed on May 22, 2015 in Germany, the disclosures of which are incorporated herein by reference in their entirety.

The disclosure concerns a fuel pump, in particular a high-pressure fuel pump, with a piston, on the end portion of which, facing a drive, a sealing device is arranged radially surrounding the piston.

The disclosure furthermore concerns a method for production of such a fuel pump, in particular a high-pressure fuel pump.

BACKGROUND

In fuel systems of internal combustion engines, fuel pumps are used for transporting fuel. In systems with direct petrol injection, the fuel pumps are supplemented by high-pressure fuel pumps which compress the fuel, supplied for example by an electric fuel pump at a pre-pressure, in sufficient quantities to the level necessary for the high-pressure petrol injection.

Such fuel pumps usually have at least one piston which can be moved axially by means of a drive formed by a cam or an eccentric disk. A necessary return force of the piston is generated by means of a compression spring. For example, a spring plate pressurized by a compression spring is pressed onto an end portion of the piston. A piston seal, arranged radially outward on the piston, can separate a first fuel-side portion of the piston from a second oil-side portion of the piston, which keeps mixing of fuel and oil at least to a low level. One such piston seal, also called a low-pressure seal, is normally held by a holding device, also known as a seal carrier. The seal carrier is connected to the housing of the high-pressure fuel pump such that here too, the oil-side portion of the fuel pump is reliably sealed from a fuel-side portion, wherein the seal carrier constitutes a static seal against the low-pressure seal and against the housing.

The seal carriers are for example made from deep-drawn elements which undergo a substance-bonding to the housing of the high-pressure fuel pump by means of a laser weld seam, and thus provide a static seal between the oil and fuel sides.

SUMMARY

The object of the disclosure is to provide a fuel pump, the production of which allows improved cycle times when joining or welding the seal carrier, and improved fault detection during the production process.

This object is achieved by a high-pressure fuel pump with a piston, on the end portion of which, facing a drive, a sealing device is arranged radially surrounding the piston, wherein the sealing device is held by at least one seal carrier, and wherein the seal carrier is connected at least in portions to a housing of the fuel pump, in that the seal carrier has at least one radially peripheral portion at which the seal carrier is substance-bonded to the housing by means of capacitor discharge welding.

The substance-bonded connection of the seal carrier to the fuel pump housing by means of capacitor discharge welding reduces the cycle time in production of the fuel pump, since by means of the capacitor discharge welding, a faster and more precise substance-bonded connection can be created between the seal carrier and the housing. In particular, with capacitor discharge welding in comparison with a laser welding process, almost no spatter and no smoke occur. Thus, there is also no need for regular cleaning of the protective glass, for example to verify the quality of the weld.

Any leaks which may occur on a weld seam produced using the previously normal welding processes, in particular laser welding, can only be established during the so-called line-end test during the leak test. By using capacitor discharge welding, the welding process can be monitored during production. Preferably, a so-called sink travel or settling travel and/or the current development during the capacitor discharge welding are monitored. In this way, it is possible to detect rejects significantly earlier, which facilitates adaptation of the production process and reduces fault costs.

According to a possible embodiment, the seal carrier comprises a first portion extending substantially axially and surrounding the sealing device radially, a second portion adjacent to the first portion and extending substantially radially outward, and a radially outer connecting portion adjacent to the second portion and substance-bonded to the housing of the fuel pump by means of capacitor discharge welding. Preferably, the connecting portion of the seal carrier has an angle of approximately 30° to 60°, preferably approximately 40° to 50° relative to the axis of the piston. The radial extension of this connecting portion is approximately 2 mm to 4 mm, preferably around 3 mm. With these embodiments, a connecting length of at least around 1 mm can be achieved with capacitor discharge welding, whereby a robust and securely sealed weld seam is created.

According to a preferred embodiment, a gap of at least approximately 0.1 mm is formed between the second portion of the seal carrier and the housing. This ensures that no undesirable or undefined shunt occurs during performance of the capacitor discharge welding.

According to another possible embodiment, the second portion of the seal carrier is connected to the housing of the fuel pump by means of a press fit. In this embodiment, a particularly stable connection can be achieved between the seal carrier and the housing.

Preferably, the connecting portion of the seal carrier is substance-bonded to the housing by means of capacitor discharge welding at a radially peripheral shoulder of the housing. The provision of the radially peripheral shoulder on the housing allows improved production of the fuel pump and increases the stability of the substance-bonded connection.

The object is also achieved by a method for production of the fuel pump, wherein the method comprises the following steps:

- arranging the housing at a first electrode of a welding device for capacitor discharge welding;
- arranging the seal carrier on a radially inner portion of the housing;
- arranging a substantially annular second electrode on a radially peripheral connecting portion of the seal carrier, wherein the second electrode applies a predefinable force to the seal carrier in a springing and/or floating manner;
- adjusting and/or centering the seal carrier in the housing;
- performing a capacitor discharge welding between the connecting portion of the seal carrier and the housing.

By means of this method, a substance-bonded connection can be created between the seal carrier and the housing of the high-pressure fuel pump, whereby the above advantages are achieved.

According to a possible embodiment, the second portion of the seal carrier is pressed by means of a press fit into a radially inner portion of the housing, and the capacitor discharge welding is carried out on a connecting portion of the seal carrier.

Preferably, during the capacitor discharge welding, a force and/or a movement of the seal carrier relative to the housing and/or a current development of the capacitor discharge welding is determined. The values determined in this way may be used to determine the quality of the weld connection. Preferably, the determined values are compared with stored values for the force, relative movement and/or current development.

BRIEF DESCRIPTION OF THE DRAWINGS

Further features, possible applications and advantages of the disclosure arise from the description below of exemplary embodiments of the disclosure which are explained with reference to the drawings, wherein the features, both alone and in various combinations, may be important for the disclosure without further explicit reference to this being required. The drawing shows.

DETAILED DESCRIPTION

Figure 1:
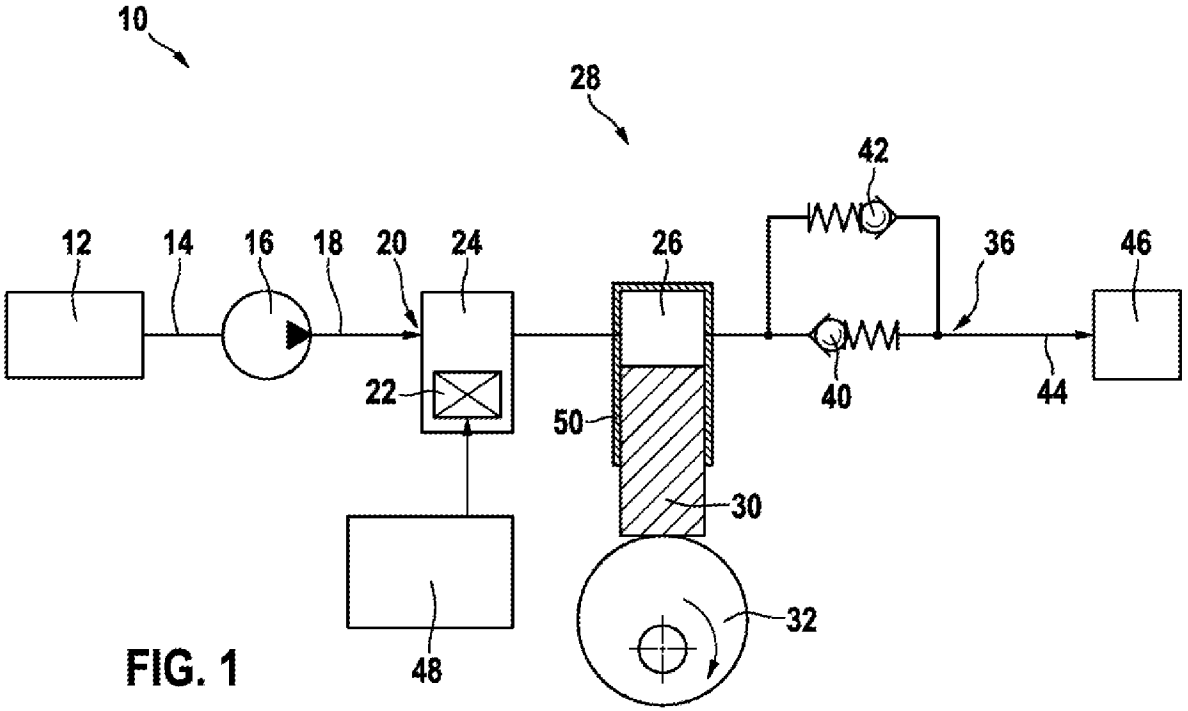
FIG. 1 a simplified diagrammatic depiction of a fuel system for an internal combustion engine.

FIG. 1 shows a fuel system 10 for an internal combustion engine, not shown in further detail, in a simplified diagrammatic depiction. Fuel is delivered from a fuel tank 12 via a suction line 14 by means of a predelivery pump 16, and a low-pressure line 18 via an inlet 20 of a quantity control valve 24 which can be activated by an electromagnetic actuation device 22, to a delivery chamber 26 of a high-pressure fuel pump 28. For example, the quantity control valve 24 may be an inlet valve with forced opening of the high-pressure fuel pump 28.

In the present case, the high-pressure fuel pump 28 is configured as a piston pump, wherein a piston 30 can be moved, vertically in the drawing, by means of a cam disk 32 (drive). An outlet valve 40, drawn as a spring-loaded check valve in FIG. 1, is arranged hydraulically between the delivery chamber 26 and an outlet 36 of the high-pressure fuel pump 28, and can open towards the outlet 36. The outlet 36 is connected to a high-pressure line 44 and via this to a high-pressure accumulator 46 (common rail). Furthermore, a pressure-limiting valve 42, also drawn as a spring-loaded check valve, is arranged hydraulically between the outlet 36 and the delivery chamber 26, and can open towards the delivery chamber 26.

In operation of the fuel system 10, the predelivery pump 16 transports fuel from the fuel tank 12 into the low-pressure line 18. The quantity control valve 24 may be closed and opened depending on the respective demand for fuel. In this way, the fuel quantity delivered to the high-pressure accumulator 46 is influenced. The electromagnetic actuation device 22 is activated by a control and/or regulator device 48.

Figure 2:
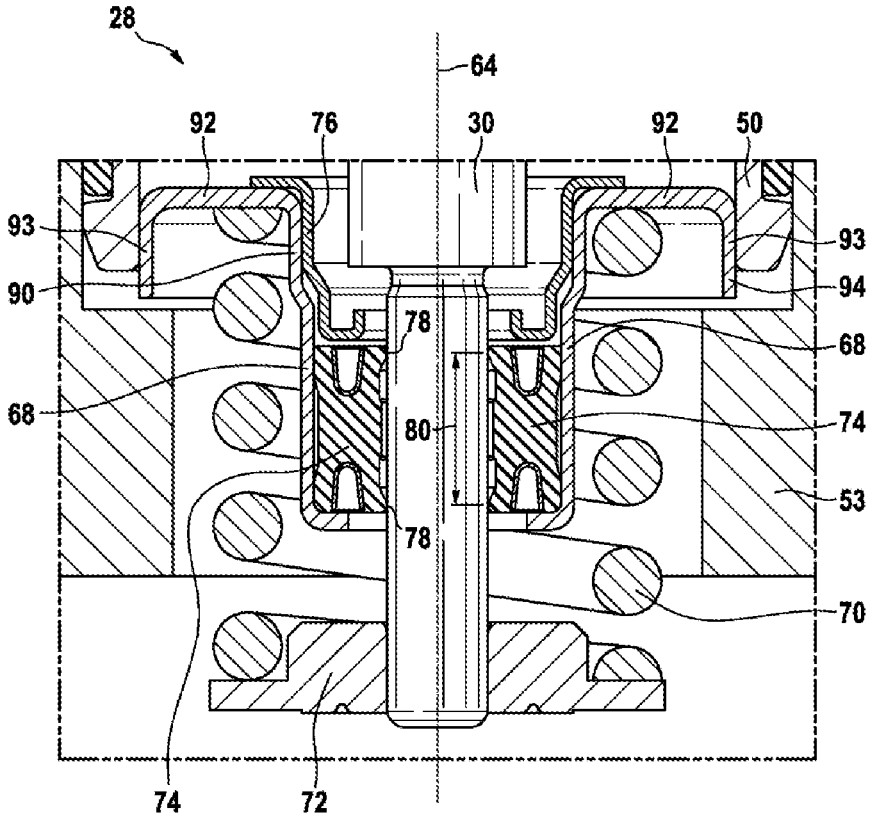
FIG. 2 an extract of a longitudinal section through a high-pressure fuel pump.

FIG. 2 shows an extract of a high-pressure pump 28 which comprises a seal carrier 68, formed approximately pot-shaped, and a piston spring 70 which is arranged radially outwardly around a portion of the seal carrier 68 and configured as a coil spring, and rests with an end portion on the seal carrier 68. A spring plate 72 is pressed onto an end portion of the piston 30, at the bottom in the drawing and facing the drive, and receives an end portion of the piston spring 70.

A piston seal, also known as a low-pressure seal and referred to as the sealing device 74, is arranged radially inside the seal carrier 68 and radially surrounds the lower second portion (facing the drive) of the piston 30; it also seals a fluid space (step chamber) present between the housing 50 and the seal carrier 68, outwardly towards the engine block 53. The piston 30 can move along the longitudinal axis 64 relative to the sealing device 74. In a rough approximation, the sealing device 74 as a whole has an annular structure.

In the present case, the sealing device 74 is supported axially—at the top in FIG. 2—by a holding portion 76 arranged inside the seal carrier 68 and also formed approximately hat-like. In the drawing, a spatial region above the sealing device 74 constitutes a "fuel side", and a spatial region below the sealing device 74 is an "oil side".

Furthermore, the sealing device 74 is supported axially—at the bottom in FIG. 2—by a peripheral edge portion of the seal carrier 68 which is bent radially inward. It is understood that the sealing device 74 may also in some cases have a slight axial play inside a region determined by the holding portion 76 and said edge portion.

The sealing device 74 is arranged on the piston 30 radially outwardly along the longitudinal axis 64, and configured so as to be substantially rotationally symmetrical.

Figure 3:
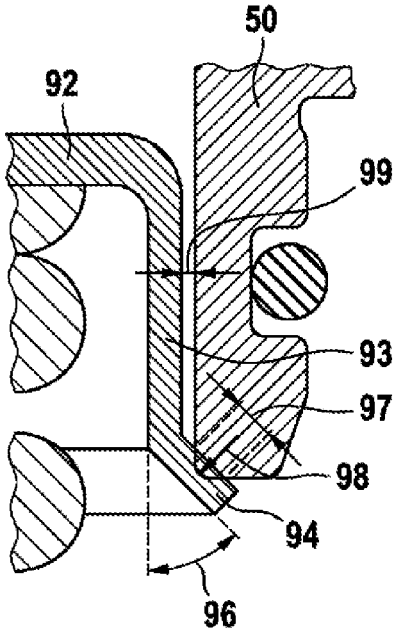
FIG. 3 an axial sectional view of the radially outer edge region of the seal carrier and of a portion of the housing of the high-pressure fuel pump according to a possible embodiment.

FIG. 3 shows a part of the second portion 92, which extends substantially radially outward and is also shown in FIG. 2, and a radially outer edge region 93 which is adjacent to the second portion 90 and has a connecting portion 94. According to the embodiment shown in FIG. 3, the connecting portion 94 has an angle 96 relative to the piston axis which, in a possible embodiment, amounts to approximately 45°. Preferably, the angle 96 lies in ranges between approximately 30° and 60°. It is advantageous if the angle 96 lies in a range between 40° and 50°, and quite particularly advantageous if the angle 96 amounts to approximately 45°, as shown in FIG. 3.

In order to achieve a connecting length 97 of around 1 mm in the performance of the capacitor discharge welding process, it is advantageous if a radius 98 of at least around 0.3 mm of the housing 50 meets a face of the seal carrier 68 or a connecting portion 94 which is angled by the angle 96.

Preferably, the more solid component has the radius 98. In this way, the conduction cross-section is reduced so that the solid component (in this case, the housing 50 of the high-pressure fuel pump 28) is melted substantially as early as the thinner-walled component (in this case, the seal carrier 68) and a robust weld seam is created. In order to avoid an undesirable or undefined shunt during the welding process, according to the embodiment shown in FIG. 3, a minimum gap 99 of around 0.1 mm is retained between the housing 50 and the edge region 93 of the seal carrier 68.

Figure 4:
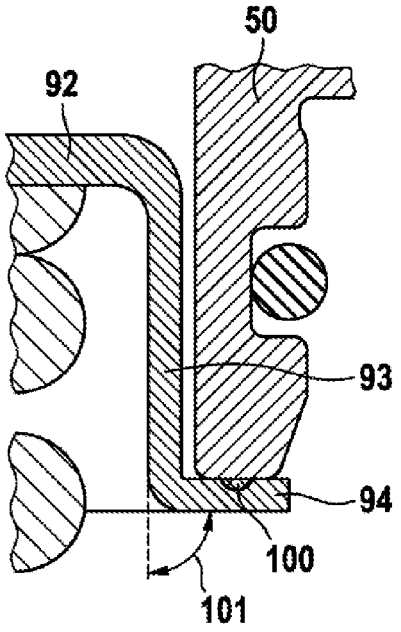
FIG. 4 an axial sectional view of a radially outer edge region of the sealing device and of a portion of the housing of the high-pressure pump according to another possible embodiment.

FIG. 4 shows the same portion of the housing 50 of the high-pressure fuel pump 28 and seal carrier 68 as in FIG. 3, but according to another possible embodiment in which the weld seam is formed by means of a ring bulge 100. The ring bulge 100 is formed on the housing 50 of the high-pressure pump 28 before the welding process. The connecting portion 94 is here tilted by an angle 101 of around 90° about the longitudinal axis 64 of the piston 30. This allows a particularly stable weld, but other angles of the connecting portion 94 are however possible.

Figure 5:
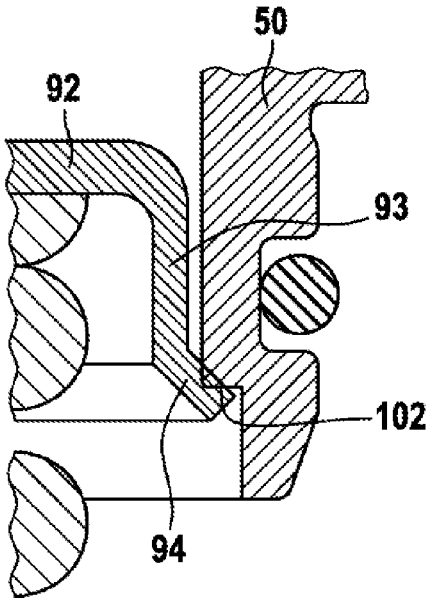
FIG. 5 an axial sectional view of a radially outer edge region of a seal carrier and of a portion of a housing according to a further possible embodiment.

According to another possible embodiment, as shown in FIG. 5, it may be provided to arrange a shoulder 102 on the housing 50 of the high-pressure fuel pump 28 at which the capacitor discharge welding takes place, whereby it is possible to shorten the lever arm and reduce the load.

Figure 6:
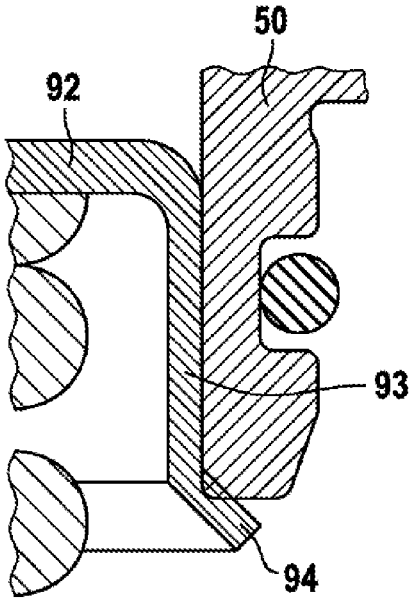
FIG. 6 an axial sectional view of a seal carrier and of a housing according to a possible embodiment.

FIG. 6 shows a further possible exemplary embodiment in which the radially outer edge region 93 is also pressed onto the housing 50 of the high-pressure fuel pump 28, whereby an even more stable connection is possible. Evidently, the enlarged contact area must be taken into account in performance of the capacitor discharge welding process.

Figure 7:
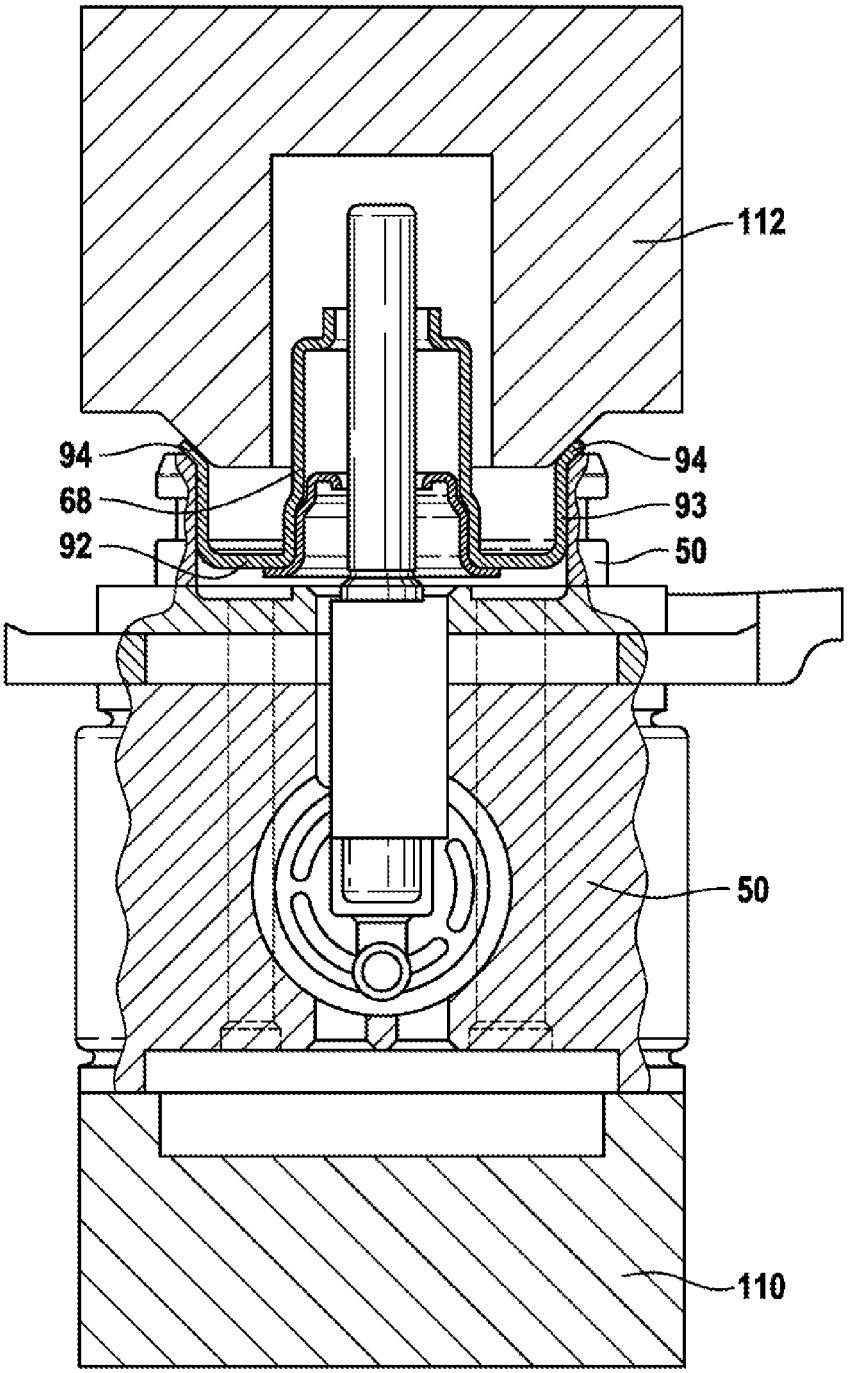
FIG. 7 a diagrammatic depiction of a sectional view of a part of the high-pressure fuel pump during performance of the capacitor discharge welding process.

FIG. 7 shows an arrangement with which the capacitor discharge welding process according to the disclosure can be performed. For this, the housing 50 of the high-pressure fuel pump 28 is arranged at a first electrode 110. A substantially annular second electrode 112 is arranged at the connecting portion 94 of the seal carrier 68. The connecting portion 94 is formed for example as shown in FIG. 3. Preferably, the second electrode 112 is configured such that it applies a predefinable force to the seal carrier 68 or the connecting portion 94 in a springing and/or floating manner. After adjusting and/or centering the seal carrier 68 in the housing 50, the capacitor discharge welding process is carried out so that a weld seam is formed between the connecting portion 94 and the part of the housing 50 lying thereon.

Figure 8:
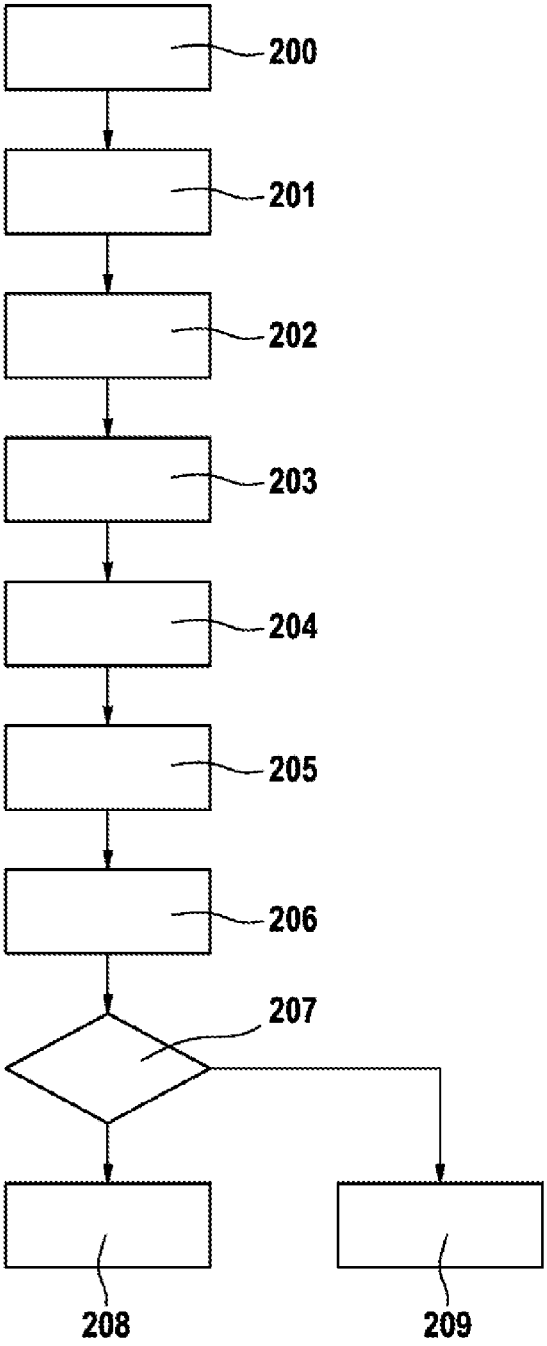
FIG. 8 a simplified flow diagram with possible method steps in the production of the high-pressure fuel pump.

FIG. 8 shows in a flow diagram method steps which are carried out according to a possible embodiment of the method of the disclosure in the production of the high-pressure fuel pump 28.

The method begins with a step 200 in which the housing 50 of the high-pressure fuel pump 28 is positioned on the first electrode 110. In a step 201, the seal carrier 68 is inserted and pre-positioned. In a step 202, the second electrode 112 is applied and mounted in a floating fashion. Preferably, its own weight is selected such that the force necessary for the later welding process is produced.

In a step 203, the arrangement is centered, and in step 204, the monitoring of the process parameters begins, in particular the sink travel, the force and/or the current development in performance of the welding process.

In a step 205, the capacitor discharge welding takes place so that the seal carrier 68 in the connecting portion 94 is substance-bonded to the housing 50 of the high-pressure fuel pump 28.

In a step 206, the process parameters monitored in step 204 are evaluated. Here, the sink travel of the second electrode 112, also known as the settling travel, and the current development in performance of the capacitor discharge welding process, are particularly relevant. These output parameters from production are compared with predefined values in a step 207. If deviations can be found which exceed a predefinable tolerance threshold, in a step 209 the production process of this high-pressure fuel pump 28 is interrupted and it is declared rejected. Where applicable, some parameters for the welding process are adapted. If the monitored process parameters lie within the predefinable tolerance ranges, the method ends in a step 208.

Because the output parameters can be examined directly for defects, any rejection is declared significantly earlier, which substantially facilitates any corrective intervention and saves defect costs.

By the use of the capacitor discharge welding process, the cycle time is reduced in the production of the high-pressure fuel pump 28, in particular in the substance-bonding of the seal carrier 68 to the housing 50 of the high-pressure fuel pump 28. Furthermore, by the use of the capacitor discharge welding process, there is no need for regular cleaning of the protective glass, which is required for example with the laser welding process in order to verify fault-free welding.

With the method according to the disclosure, a leaking laser weld seam is not established only in the line-end test during the leak test performed there, but it is possible, already during production by the analysis of process parameters, to establish whether the welding process was successful.

The invention claimed is:

1. A fuel pump, comprising:

a housing;

at least one piston;

a sealing device positioned on the at least one piston so as to radially surround the piston; and a seal carrier having a radially outer edge region, wherein the radially outer edge region includes a connecting portion with an angle of approximately 30° to 60° relative to an axis of the at least one piston, wherein the connecting portion extends radially approximately 2 millimeters to 4 millimeters, and wherein the connecting portion is substance-bonded to the housing of the fuel pump via a capacitor discharge weld connection.

2. The fuel pump as claimed in claim 1, wherein the radially outer edge region is connected to the housing of the fuel pump via a press fit.

3. The fuel pump as claimed in claim 1, wherein:

the housing includes a radially peripheral shoulder, and the connecting portion is substance-bonded to the housing via the capacitor discharge weld connection at the radially peripheral shoulder of the housing.

4. The fuel pump as claimed in claim 1, wherein the fuel pump is a high-pressure fuel pump.

5. The fuel pump as claimed in claim 1, wherein the angle between the connecting portion and the axis of the at least one piston is approximately 40° to 50°.

6. A method of producing a fuel pump, comprising:

positioning a fuel pump housing at a first electrode of a capacitor discharge welding device;

positioning a seal carrier on a radially inner portion of the housing;

positioning a substantially annular second electrode of the welding device on a radially peripheral connecting portion of the seal carrier, wherein the second electrode is configured to apply a predefinable force to the seal carrier;

at least one of adjusting and centering the seal carrier in the housing; and operating the welding device to form a capacitor discharge weld connection between the radially peripheral connecting portion of the seal carrier and the housing.

7. The method as claimed in claim 6, wherein:

an edge region of the seal carrier has a press fit at the radially inner portion of the housing; and the capacitor discharge weld connection is formed at the radially peripheral connecting portion of the seal carrier adjacent to the edge region.

8. The method as claimed in claim 6, further comprising:

during the operation of the capacitor discharge welding device, determining at least one of a force of the seal carrier relative to the housing, a movement of the seal carrier relative to the housing, and a current development of the capacitor discharge welding device and comparing the at least one of determined force, determined relative movement, and determined current development with at least one corresponding stored value for the force, relative movement, and current development and determining a quality of the weld connection based on the comparison.

9. The method as claimed in claim 6, wherein the fuel pump is a high-pressure fuel pump.

* * * * *